United States Patent [19]

Wey et al.

[11] 4,397,139

[45] Aug. 9, 1983

[54] CONTROLLED COMPRESSED AIR SPLICING DEVICE

[75] Inventors: Edmund Wey, Nettetal; Gregor Kathke, Viersen; Herbert Knors; Klaus Rosen, both of Monchen-Gladbach, all of Fed. Rep. of Germany

[73] Assignee: W. Schlafhorst & Co., Monchen-Gladbach, Fed. Rep. of Germany

[21] Appl. No.: 298,524

[22] Filed: Sep. 1, 1981

[30] Foreign Application Priority Data

Sep. 3, 1981 [DE] Fed. Rep. of Germany ..... 3033050

[51] Int. Cl.[3] ..... D01H 15/00

[52] U.S. Cl. ..... 57/22; 57/264

[58] Field of Search ..... 57/22, 23, 261, 262, 57/263, 264

[56] References Cited

U.S. PATENT DOCUMENTS

| | | | |
|---|---|---|---|
| 3,379,002 | 4/1968 | Rosenstein | 57/22 X |
| 3,407,583 | 10/1968 | Irwin et al. | 57/22 |
| 4,002,012 | 1/1977 | Norris et al. | 57/22 |
| 4,344,277 | 8/1982 | Rohner et al. | 57/22 |

*Primary Examiner*—Donald Watkins

*Attorney, Agent, or Firm*—Herbert L. Lerner; Laurence A. Greenberg

[57] ABSTRACT

Controlled compressed-air splicing device for textile threads with a controlled compressed-air metering valve supplied from a compressed-air supply device, including an automatic quality control device for ensuring the quality of spliced joints formed by the splicing device.

1 Claim, 1 Drawing Figure

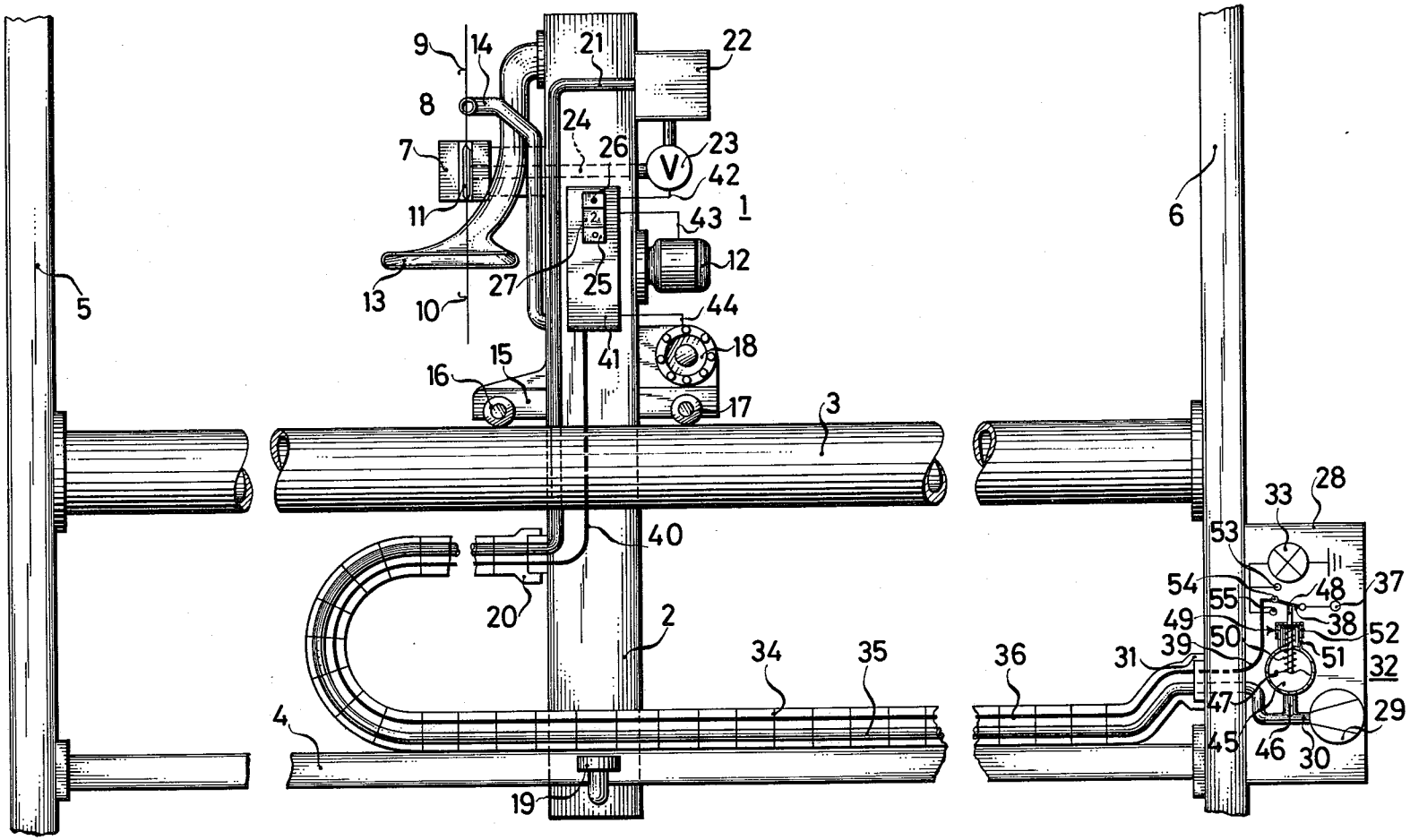
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55

CONTROLLED COMPRESSED AIR SPLICING DEVICE

The invention relates to a controlled compressed-air splicing device for textile threads with a controlled compressed-air metering valve supplied with compressed air from a compressed-air supply device. Such compressed-air splicing devices have become known heretofore, for example, from German Published Non-Prosecuted Application (DE-OS) No. 28 15 999. The compressed-air splicing device is connected to the compressed-air supply device by a compressed-air line.

It is a disadvantage that, in the heretofore known compressed-air splicing devices, the quality of the spliced joints is not assured. For example, independently of the magnitude of the air pressure, spliced joints are formed having a quality which proves to be different, however, with respect to strength, appearance, length, diameter, cross section, fuzziness or the like, depending upon the magnitude of the air pressure and the type of spliced textile threads.

It is accordingly an object of the invention to provide a controlled compressed-air splicing device which ensures that a given fixed or set quality of the spliced joint is maintained.

With the foregoing and other objects in view, there is provided, in accordance with the invention, a controlled compressed-air splicing device of the foregoing general type which is equipped with an automatic quality assurance or control device for ensuring the quality of the spliced joints formed by the splicing device.

In accordance with another feature of the invention, the qualityassurance or control device comprises a pressure monitor having an adjusting device for a minimum pressure and/or tolerance limits of a pressure range, the pressure monitor communicating with the compressed-air supply device and being operatively connected to a locking device of the compressed-air splicing device and/or to an alarm device.

The advantages attained with the invention are, especially, that the compressed-air splicing device automatically maintains the tolerance limits of the quality of the spliced joints. The instant the prerequisite conditions for maintaining the quality of the spliced joints are no longer met, the compressed-air splicing device either shuts down automatically and/or an alarm is sounded. There are several possibilities for shutting down the compressed-air supply device. The controlled valve can be shut off, the switch for the drive motor of the compressed-air splicing device can be opened i.e. switched off., or a double-throw switch can be actuated which switches off or disconnects the power supply of the compressed-air splicing device and switches on an alarm device. If the compressed-air splicing device is of a type which can travel along a textile machine, such as a winding machine, for example, it can also be shut down simply by switching off the motor of the travel mechanism.

Other features which are considered as characteristic for the invention are set forth in the appended claims.

Although the invention is illustrated and described herein as embodied in a controlled compressed-air splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic and partly schematic front elevational view of the controlled compressed-air splicing device according to the invention.

Referring now to the drawing, there is shown therein a compressed-air splicing device identified as a whole by the reference numeral 1 and formed of a carriage 2 which is arranged so that it can travel on a support tube 3 and along a rail or track 4 past work stations of a textile machine (spinning stations, winding stations or the like). The support tube 3 and the track 4 are fastened to end frames 5 and 6 of the textile machine.

The compressed-air splicing device 1 has a splicing head 7 formed with a slot 8 open toward the front, into which two textile threads 9 and 10 are inserted which have previously been spliced together by a spliced joint 11. Suction grippers 13 and 14 controllable and movable by a drive motor 12 serve for seizing or gripping, firmly holding and inserting the threads.

The carriage 2 has a chassis 15 with rollers 16 and 17. The roller 17 is driven by a travel-unit motor 18. At the lower end of the carriage 2 a support roller 19 is braced against the rail or track 4.

From a connector plug 20, a pipe 21 extends through a compressed-air accumulator 22 to a controlled compressed-air dosing or metering valve 23. From the latter, a compressed-air channel 24 extends to the splicing head 7. The compressed-air metering valve 23 is actuated by a control switch 25. The control switch 25 has a control knob 26 for the "on" time of the compressed-air metering valve 21 and an indicator field or panel 27 for indicating the set "on" time.

On a traverse of cross tie 28 of the machine frame 6, there is provided a compressed-air supply device 29, from which a pipeline 30 extends to a connector plug 31. On the traverse 28, there is further provided a quality assurance or control device generally identified as a whole by reference numeral 32 and an alarm device 33.

A drag chain 34 carrying a flexible compressed-air line 35 and a flexible electric line 36 lies on the rail 4. The two flexible lines 35 and 36 extend, respectively, from the connector plug 31 to the connector plug 20.

The compressed-air splicing device 1 is supplied with power from a voltage source 37 via a locking device 38, an electric line 39, the flexible electric line 36 and an electric line 40. The electric line 40 terminates in a control box 41 which also carries the control switch 25. From the control box 41, respective electric lines 42, 43 and 44, respectively, lead to the compressed-air metering valve 23, to the drive motor 12 and to the traveling-unit motor 18.

The quality assurance or control device 32 has a pressure monitor 45, a pressure connector 46 of which is connected to the pipeline 30. Inside the pressure monitor 45, there is a diaphragm 47, from which an operative connection 48 in the form of a switching rod extends to the locking device 38 which is constructed as a double-throw switch. At the pressure monitor 45, there is further provided an adjusting device 49 formed of a compression spring 50, a tube 51 provided with an external thread and an adjustable cap nut 52 overlapping the tube 51 and the compression spring 50.

The compressed-air splicing device 1 is drivable on the support tube 3 and along the track or rail 4 to the respective disrupted work station. Thereat, the compressed-air splicing device 1 becomes operative and disposes of or corrects the thread break by splicing in a conventional manner. The figure of the drawing shows the compressed-air splicing device 1 in operatively ready condition thereof. The spliced joint 11 has, in fact, just been made. The locking device 38 is switched on. Through the adjusting device 49, the tolerance limits of the qualtiy of the spliced joint 11 are set insofar as the pressure monitor 45 is set to a given pressure range. If the adjusted pressure deviates downwardly, the compression spring 50 forces the diaphragm 47 downwardly and the locking device 38 switches from the contact 54 to the contact 55. The entire power supply of the compressed-air splicing device is thereby interrupted and the alarm device 33 is simultaneously switched on.

The compressed-air splicing device 1 would then no longer be able to travel farther on the support tube 3, to operate the suction grippers 13 and 14 or to switch on the compressed-air metering valve 23.

If the pressure in the pressure monitor 45 deviates upwardly, the diaphragm 47 is forced upwardly against the bias of the compression spring 50, and the locking device 38 is switched via the operative connection 38 from the contact 54 to the contact 53. The entire power supply to the compressed-air splicing device 1 is thereby also interrupted and the alarm device 33 is simultaneously switched on.

If the required and desirable air pressure is not present from the start, the locking device 38 is not located at the contact 54 and the entire compressed-air splicing device 1 is locked from the start.

In the hereinaforedescribed embodiment of the invention, the locked condition is immediately abolished or reversed again automatically as soon as the desired pressure is present again in the pipeline 30.

As mentioned hereinbefore, the invention is not limited, however, to the described and illustrated embodiment.

It may be advantageous, for example, only to give a signal when the normal pressure return and manually to reactivate the device after the cause of the pressure deviation has veen determined and, if necessary, corrected. Oscillating switching-on and off due to a major leak could thus be prevented.

Alternatively, the locking can also be accomplished in such a manner that a possibly previously started splicing process is first completed and only then is the locking operation proper performed. This would afford the advantage that the splicing device, upon restarting, would always be in the null or neutral position of operative readiness.

Instead of locking the power supply of the splicing device, locking of a control line could also be selected. The amount of equipment could also be thereby be reduced because no circuit breakers or heavy-duty switches, but only control switches would be required.

Furthermore, it would be advantageous, in individual cases, to include in the locking operation that work station at which the splicing device is operative.

In individual cases, also, a stationary splicing device without any travel mechanism can be of advantage. In this case, either every work station, such as a winding station of a textile machine, for example, has a splicing device, or the work stations are conducted past the stationary splicing device. The quality assurance or control device could also be associated in common with several splicing devices, if several splicing devices have a common compressed-air supply device.

We claim:

1. Controlled compressed-air splicing device for textile threads with a controlled compressed-air metering valve supplied from a compressed-air supply device, comprising an automatic quality control device for ensuring the quality of spliced joints formed by the splicing device, said quality control device comprising a pressure monitor having an adjusting device for at least one of a minimum pressure, on the one hand, and tolerance limits of a pressure range, on the other hand, said pressure monitor communicating with the compressed-air supply device and being operatively connected to at least one device of a locking device for locking the compressed-air splicing device and an alarm device for signaling when the pressure deviates from a given pressure.

* * * * *